US009028050B2

(12) United States Patent
Munakata

(10) Patent No.: US 9,028,050 B2
(45) Date of Patent: May 12, 2015

(54) FLOW PATH UNIT, LIQUID EJECTING HEAD, LIQUID EJECTING APPARATUS, AND METHOD OF MANUFACTURING FLOW PATH UNIT

(71) Applicant: Seiko Epson Corporation, Tokyo (JP)

(72) Inventor: Manabu Munakata, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/449,403

(22) Filed: Aug. 1, 2014

(65) Prior Publication Data

US 2015/0042729 A1 Feb. 12, 2015

(30) Foreign Application Priority Data

Aug. 9, 2013 (JP) ..... 2013-166883

(51) Int. Cl.
*B41J 2/045* (2006.01)
*B41J 2/14* (2006.01)
*B41J 2/16* (2006.01)

(52) U.S. Cl.
CPC ..... *B41J 2/14201* (2013.01); *B41J 2/1612* (2013.01); *B41J 2002/14306* (2013.01)

(58) Field of Classification Search
CPC .... B41J 2/1623; B41J 2/14274; B41J 2/1612; B41J 2002/14306
USPC ..... 347/20, 68, 84, 85; 29/25.35, 890.1
See application file for complete search history.

(56) References Cited

U.S. PATENT DOCUMENTS

| | | | | |
|---|---|---|---|---|
| 6,808,250 | B2 | 10/2004 | Watanabe | |
| 7,571,525 | B2 * | 8/2009 | Matsuzawa et al. | 29/25.35 |
| 7,614,128 | B2 * | 11/2009 | Kamei | 29/25.35 |
| 8,057,018 | B2 * | 11/2011 | Yazaki et al. | 347/68 |
| 8,205,967 | B2 | 6/2012 | Uyama et al. | |
| 2002/0044175 | A1 | 4/2002 | Watanabe | |
| 2009/0212008 | A1 | 8/2009 | Uyama et al. | |

FOREIGN PATENT DOCUMENTS

| | | | |
|---|---|---|---|
| JP | 05-060844 | B2 | 8/1993 |
| JP | 10-250078 | | 9/1998 |
| JP | 2009-202401 | A | 9/2009 |
| JP | 2012-201025 | A | 10/2012 |

* cited by examiner

*Primary Examiner* — An Do
(74) *Attorney, Agent, or Firm* — Harness, Dickey & Pierce, P.L.C.

(57) ABSTRACT

Provided is a first flow path substrate where a first flow path out of a liquid flow path is formed, a second flow path substrate where a second flow path which communicates with the first flow path is formed, and a third flow path substrate where a pressure chamber which communicates with the second flow path is formed. The second flow path substrate has a first surface which is bonded to oppose the third flow path substrate and a second surface which is bonded to oppose the first flow path substrate; the first surface of the second flow path substrate is bonded with the third flow path substrate via a film of paraxylene; and the second surface of the second flow path substrate is bonded by an adhesive of a material which is different from that of the film of paraxylene.

7 Claims, 8 Drawing Sheets

FLOW PATH UNIT, LIQUID EJECTING HEAD, LIQUID EJECTING APPARATUS, AND METHOD OF MANUFACTURING FLOW PATH UNIT

BACKGROUND

1. Technical Field

The invention relates to a flow path unit which forms a liquid flow path through which liquid flows, a liquid ejecting head, and a liquid ejecting apparatus.

2. Related Art

In the related art, apparatuses are known which have a flow path through which liquid flows. In addition, a flow path unit is also known which configures a part of this flow path. The flow path unit has a pressure chamber, where the pressure is changed, in a part and connects a flow path where liquid is supplied and a flow path on the side where liquid is discharged.

In addition, a configuration where the flow path is covered with a coating film in order to protect wall surfaces of the flow path from the liquid is disclosed (for example, refer to JP-A-2009-202401, JP-UM-A-5-60844, and JP-A-10-250078. The coating film is used in order to protect the flow path from corrosion due to the characteristics of the liquids which are used or deterioration thereof over time.

In a case where a flow path is configured by laminating a plurality of substrates, when the positional alignment precision of the surfaces where the substrates are bonded with each other (also described below as the bonding surfaces) is low, there are cases where the flow path is not properly formed. For example, when the substrates are not correctly bonded with each other via the bonding surface, there are cases where differences in level occur in the joints of the flow path or where the flow path is not properly sealed at the joints. In a case where differences in level occur in the joints, air bubbles are trapped in the difference in level, which is not preferable.

SUMMARY

An advantage of some aspects of the invention is to provide a flow path unit, which is able to properly configure a flow path even in a case of bonding substrates to each other, a liquid ejecting head, and a liquid ejecting apparatus.

According to an aspect of the invention, there is provided a flow path unit which has a liquid flow path through which liquid flows and which is provided with a first flow path substrate where a first flow path out of the liquid flow path is formed, a second flow path substrate where a second flow path which communicates with the first flow path is formed, and a third flow path substrate where a pressure chamber which communicates with the second flow path is formed. The second flow path substrate has a first surface which is bonded to oppose the third flow path substrate and a second surface which is bonded to oppose the first flow path substrate; the first surface of the second flow path substrate is bonded with the third flow path substrate via a film of paraxylene; and the second surface of the second flow path substrate is bonded with the first flow path substrate via an adhesive film of a material which is different from that of the film of paraxylene.

In the aspect of the invention which is configured as described above, the first surface of the second flow path substrate which is bonded with the third flow path substrate is bonded using a film of paraxylene. On the other hand, the second surface of the second flow path substrate which is bonded with the first flow path substrate is bonded via an adhesive layer of a material other than paraxylene. Typically, in a case where a flow path is formed by superimposing three substrates, it is necessary to bond the substrates while considering the precision of the positional alignment of each of the substrates. In particular, in a case where three substrates are bonded by being positionally aligned with one jig or the like, deviation in the bonding surfaces in the previous processes has an influence on the precision of the positional alignment in the subsequent processes, and there are cases where the flow path is not properly formed. However, in the aspect of the invention, it is possible to bond the second flow path substrate and the third flow path substrate which configure the joints of the flow path while covering the bonding interface with a film of paraxylene and it is possible to properly configure the flow path even in a case where the positional precision of the second flow path substrate and the third flow path substrate is poor. That is, by interposing a film of paraxylene at the joints of the flow path, it is possible to absorb positional deviation of the holes which configure the flow path or irregularities in the diameter using the film of paraxylene. On the other hand, it is possible to bond the substrates with each other without the second surface of the second flow path substrate being influenced by the precision of the positional alignment of the first surface side. For example, it is possible to bond the substrates with each other while considering the hole diameter of the flow path by using a known film-based adhesive or the like.

Here, the pressure chamber is a space where pressure is applied to the liquid and may be any type as long as pressure is applied to the flowing liquid therein.

In addition, according to the aspect of the invention, the film of paraxylene which bonds the second flow path substrate and the third flow path substrate may be configured to include a first film which is formed on a wall surface of the pressure chamber of the third flow path substrate and a third surface (a surface which opposes the first surface of the second flow path substrate) on the second flow path substrate side of the third flow path substrate.

In the aspect of the invention which is configured as described above, the same paraxylene films are bonded with each other on the bonding surfaces of the second flow path substrate and the third flow path substrate. Therefore, in either of the second or third flow path substrates, it is not necessary to have many intersections in order to avoid the film of paraxylene which protrudes from the bonding surfaces. As a result, it is possible to properly form the flow path.

Here, according to the aspect of the invention, the film of paraxylene which is interposed between the second flow path substrate and the third flow path substrate may be configured to be thicker compared to the film thickness of the first film.

That is, after separately depositing the first film and a film which is bonded with the first film, the substrates are bonded with each other by adhering the films to each other. Therefore, it is possible to make the film thickness of the coating film which is deposited inside the liquid flow path uniform.

Furthermore, according to another aspect of the invention, the third flow path substrate may be configured of ceramics.

In a case where a part of a flow path member is configured of ceramics, there are cases where variations occur in the dimensional precision due to shrinkage caused by firing. Therefore, in the aspect of the invention which is configured as described above, absorbing a decrease in the precision of the positional alignment which occurs by configuring the third flow path substrate using ceramics is possible. As a result, it is possible to form the third flow path substrate using ceramics for which it is possible to reduce costs.

In addition, it is possible to recognize the invention not only as a flow path unit but also as an invention of a liquid ejecting head which has the flow path unit in a part.

Here, it is possible to recognize the aspect of the invention as an invention of a liquid ejecting apparatus which has the liquid ejecting head described above.

Furthermore, it is possible to recognize the aspect of the invention as a method of manufacturing a flow path unit for manufacturing such a flow path unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Below, description will be given of embodiments of the invention in the following order.

1. First Embodiment:
2. Second Embodiment:
3. Other Embodiments:

1. First Embodiment

Figure 1:
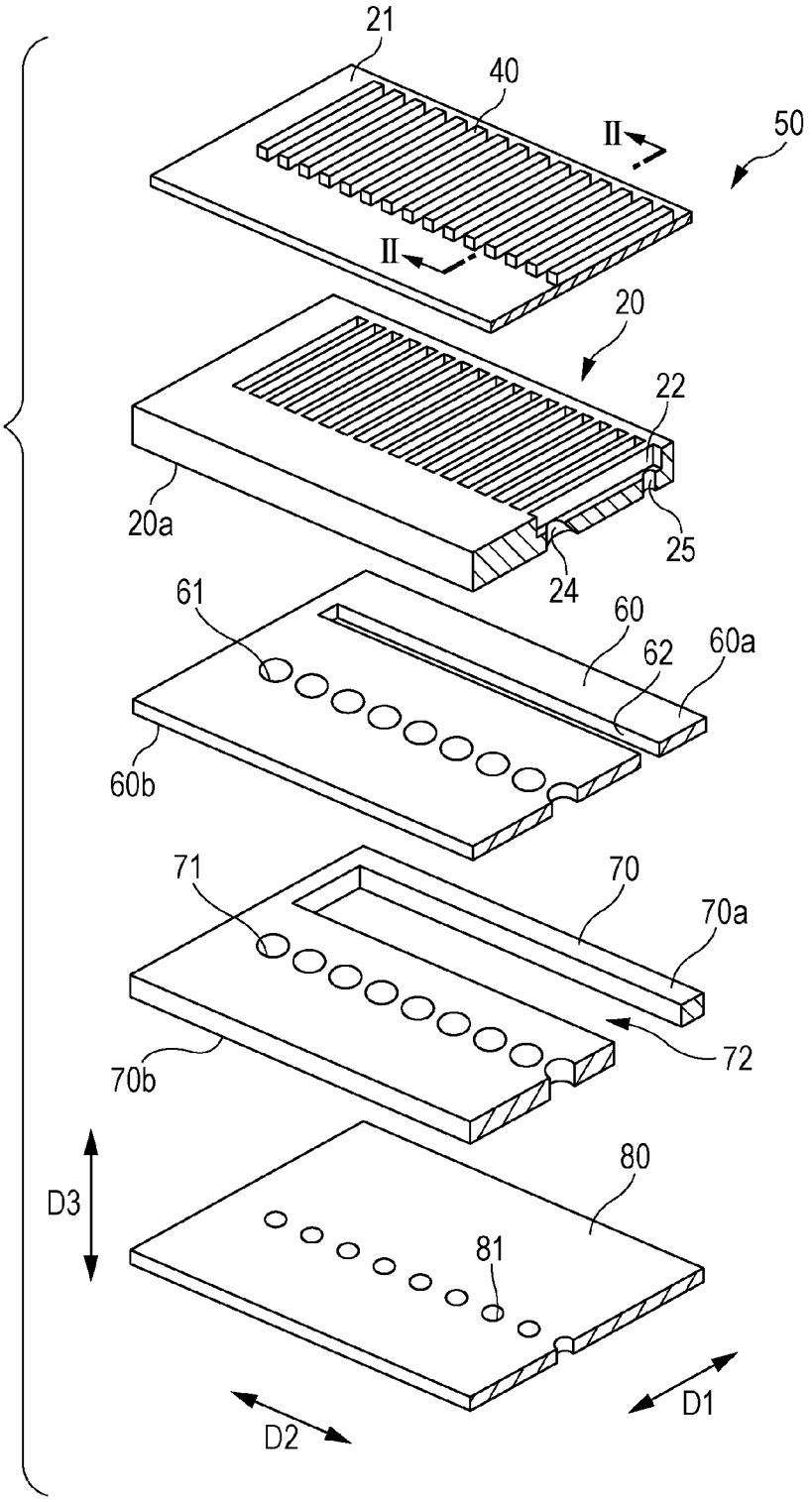
FIG. 1 is a perspective exploded diagram which illustrates a configuration of a liquid ejecting head.
Figure 2:
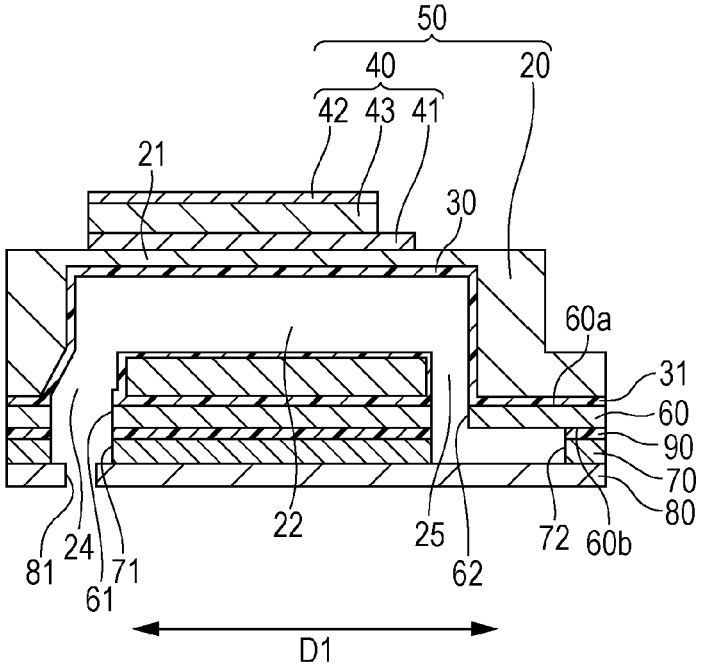
FIG. 2 is a cross sectional diagram which illustrates a configuration of a liquid ejecting head.

Below, description will be given of the first embodiment which is embodied as a liquid discharging head according to the invention with reference to the accompanying drawings. FIG. 1 is a perspective exploded diagram of a liquid ejecting head. In addition, FIG. 2 is a cross sectional diagram which illustrates a configuration of the liquid ejecting head. Here, FIG. 2 corresponds to the cross sectional diagram taken along line II-II (the longitudinal direction of the pressure chamber) in FIG. 1. Here, in the description below, the arrangement relationship of each of the configurations will be described by defining one in-plane direction of each of the plates which configure an actuator 50 as a first direction D1, another in-plane direction of each of the plates which intersect with the first direction D1 as a second direction D2, and the thickness direction of each of the plates and the normal direction of each of the plate surfaces as a third direction D3.

A liquid ejecting head 1 is used as a part of a liquid ejecting apparatus such as a printing apparatus. The liquid ejecting head 1 is provided with the actuator 50, a sealing plate 60, a reservoir plate 70, and a nozzle plate 80. In addition, a liquid flow path is configured in the inside of the liquid ejecting head 1 by the actuator 50, the sealing plate 60, the reservoir plate 70, and the nozzle plate 80 described above being laminated in the third direction D3.

Here, a compliance plate may be provided between the reservoir plate 70 and the nozzle plate 80.

The actuator 50 has a flow path forming substrate 20 (a third flow path substrate) where a pressure chamber 22 which is a part of a flow path is formed, and a pressure generating element 40 which is connected with the flow path forming substrate 20 according to the position of the pressure chamber 22.

As shown in FIG. 1, a plurality of the pressure chambers 22 are formed in the inside of the flow path forming substrate 20 so as to be arranged together in the second direction D2 (the short side direction of the pressure chamber). In the flow path forming substrate 20, the wall surface which is an upper surface of the pressure chamber 22 will also be described as a diaphragm 21. In addition, a reservoir side opening 25, which is formed such that the surface (referred to below as a lower surface/a third surface) 20*a* of the side where the sealing plate of the flow path forming substrate 20 is arranged is opened, is formed on the upstream side of the pressure chamber 22. Thus, a communication hole side opening 24, which is formed such that a lower surface 20*a* is opened, is formed on the downstream side of the pressure chamber 22. Here, a narrow section where the flow path width in the second direction D2 is narrow may be formed in the inside of the flow path forming substrate 20. Here, the flow path forming substrate is configured by laminating a thin plate bodies of ceramics. In addition, it is possible to use partially stabilized zirconia (Zr) or stabilized zirconia as a material thereof. Naturally, the flow path forming substrate 20 may be configured of aluminum oxide ($Al_2O_3$) or silicon ($SiO_2$) other than ceramics.

In the first embodiment, the reservoir plate 70 is the first flow path substrate, and the sealing plate 60 is the second flow path substrate. In addition, the flow path forming substrate 20 which configures the actuator 50 is the third flow path substrate.

Here, description will be given with the diaphragm 21 as a part of the flow path forming substrate 20. However, the diaphragm 21 and the flow path forming substrate 20 may be configured as separate members other than the above.

As shown in FIG. 2, a coating film (a first film) 30 which is formed of paraxylene (p-xylene) is formed on the wall surface of the flow path which is positioned inside the flow path forming substrate 20. A coating film 30 functions as a protective film which protects the flow path which includes the pressure chamber 22 from ink. That is, when the concentration of the number of nozzles of the liquid ejecting head 1 increases, there is a tendency for the volume of the pressure chamber 22 to be smaller and for the pressure changes of the pressure chamber 22 to be smaller. In such cases, it is possible to increase the volume change of the pressure chamber 22 by reducing the thickness of the diaphragm 21. However, when the thickness of the diaphragm 21 excessively reduced, a phenomenon (also described as a nano-ink pass) occurs where a solution of ink or the like leaks through the diaphragm 21. The nano-ink pass is remarkable when the thickness of the diaphragm 21 is 3.0 μm or less. Therefore, by depositing the coating film 30 on the inner wall of the pressure chamber 22, it is possible to suppress the nano-ink pass and reduce the thickness of the diaphragm 21 (for example, 3.0 μm or less).

In addition, pressure generating elements 40 are arranged together on the diaphragm 21 side of the flow path forming substrate 20. The pressure generating elements 40 are formed by being arranged together in the second direction D2 according to the position of the pressure chamber 22 in the flow path forming substrate 20. In the present embodiment, the pressure generating elements 40 are configured of unimorph type piezoelectric elements.

The pressure generating elements 40 are provided with a common electrode 41, an individual electrode 42, and a piezoelectric body 43 which is positioned between the common electrode 41 and the individual electrode 42 in the upper part of the diaphragm 21. The common electrode 41 is shared by a plurality of the pressure generating elements 40. In addition, the piezoelectric body 43 and the individual electrode 42 are each formed in every pressure chamber 22. The common electrode 41 or the individual electrode 42 is configured of a conductive material such as gold (Au), platinum (Pt), and iridium (Ir). In addition, the piezoelectric body 43 is configured of a dielectric body such as, for example, lead zirconate titanate (PZT).

Other than unimorph type piezoelectric elements, the pressure generating elements 40 may be a bimorph type where at least two or more piezoelectric elements are laminated, or a continuous type where a plurality of piezoelectric elements are laminated. Furthermore, the pressure generating elements 40 may be heater elements which are positioned inside the pressure chamber 22.

The sealing plate 60 (the second flow path substrate) is fixed in the lower part of the flow path forming substrate 20 via a bonding film 31. Below, the surface which opposes the flow path forming substrate 20 of the sealing plate 60 will be described as a first surface 60*a*, and the surface which opposes the reservoir plate 70 will be described as a second surface 60*b*. The sealing plate 60 is a thin plate body which has a plurality of first communication holes 61 and a common supply hole 62. The first communication holes 61 communicate one to one with the communication hole side opening 24 and are also configured as holes which connect the openings which are formed in the first surface 60*a* and the second surface 60*b* of the sealing plate 60. In addition, the common supply hole 62 is configured as a rectangular slit by a plurality of reservoir side openings 25 in the flow path forming substrate 20 being connected in common, of which the longitudinal side extends in the second direction D2 and which connects the openings which are formed in the first surface 60*a* and the second surface 60*b*.

The sealing plate 60 is configured of ceramics where partially stabilized zirconia or stabilized zirconia is used, or by metals.

Figure 3:
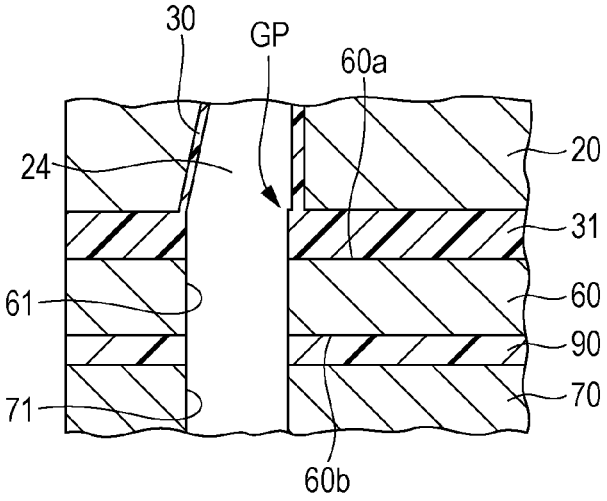
FIG. 3 is a cross sectional diagram which shows an enlarged part of a bonding interface between a flow path forming substrate and a sealing plate.

FIG. 3 is a cross sectional diagram which shows an enlarged part of a bonding interface between the flow path forming substrate 20 and the sealing plate 60. In order to simplify the description, only the bonding film 31 which is formed in the flow path is shown in FIG. 3. The first surface 60*a* of the sealing plate 60 is fixed (bonded) with the flow path forming substrate 20 via the bonding film 31. That is, the first communication holes 61 of the sealing plate 60 communicate with the communication hole side opening 24 of the flow path forming substrate 20 in a state where the bonding film 31 is interposed. Here, although not illustrated in FIG. 3, the common supply hole 62 of the sealing plate 60 communicates with a plurality of the reservoir side openings 25 of the flow path forming substrate 20 in a state where the bonding film 31 is interposed.

In the present embodiment, the bonding film 31 includes a part of the coating film 30. That is, the coating film 30 which covers the wall surface of the flow path inside the flow path forming substrate 20 is formed by extending from the side of the communication hole side opening 24 and the reservoir side opening 25 and also continuing to the lower surface 20*a* side of the flow path forming substrate 20, thereby configuring the bonding film 31. Therefore, the bonding film 31 is configured of paraxylene (p-xylene) in the same manner as the coating film 30.

Since the flow path forming substrate 20 is configured of ceramics, firing shrinkage or the like occurs, and the positional precision of the opening is poor in comparison with the positional precision of the openings of the first communication holes 61 and the common supply hole 62 which are formed in the second surface 60*b* of the sealing plate 60. When there are variations in the precision of the positional alignment, there are cases where it is not possible to properly configure the flow path in a case where three substrates are bonded by being positionally aligned with one jig or the like. Therefore, a gap GP is generated in the radial direction in the communication hole side opening 24 of the flow path forming substrate 20 and the first communication holes 61 of the sealing plate 60 due to the poor positional alignment precision. In contrast, when the position of the sealing plate 60 is adjusted in order to eliminate the gap GP in the flow path, there may be cases where the gap is generated at the joints of the flow path between the sealing plate 60 and the reservoir plate 70 (the first flow path substrate).

However, by bonding the flow path forming substrate 20 and the sealing plate 60 using the bonding film 31 which is configured of paraxylene (p-xylene), the joints of the flow path are coated with the bonding film 31, and it is possible to smooth the gap GP. That is, by interposing the film of paraxylene at the joints of the flow path, it is possible to absorb the positional deviation of the holes which configure the flow path or the irregularities in the diameter using the film of paraxylene. Therefore, it is possible for the sealing plate 60 to perform the positional alignment between the substrates (the sealing plate 60 and the reservoir plate 70) by prioritizing the precision of only the second surface 60*b* side. Therefore, it is possible to perform bonding on the second surface 60*b* side using an adhesive method which requires precision between the substrates, for example, a known film adhesive.

In addition, by the bonding film 31 being the same material as the coating film 30 which covers the flow path of the flow path forming substrate 20, it is possible to properly bond the substrates with each other even when the coating film 30 protrudes to the lower surface 20*a*.

Figure 4A:
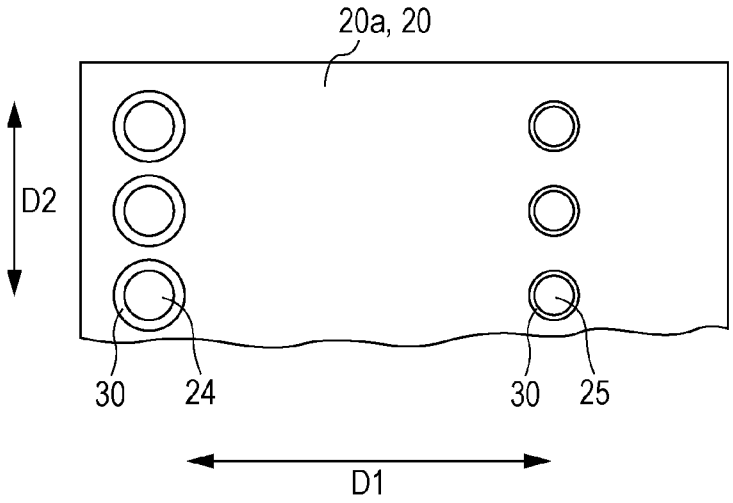
FIGS. 4A to 4B are diagrams which illustrate bonding between substrates.
Figure 4B:
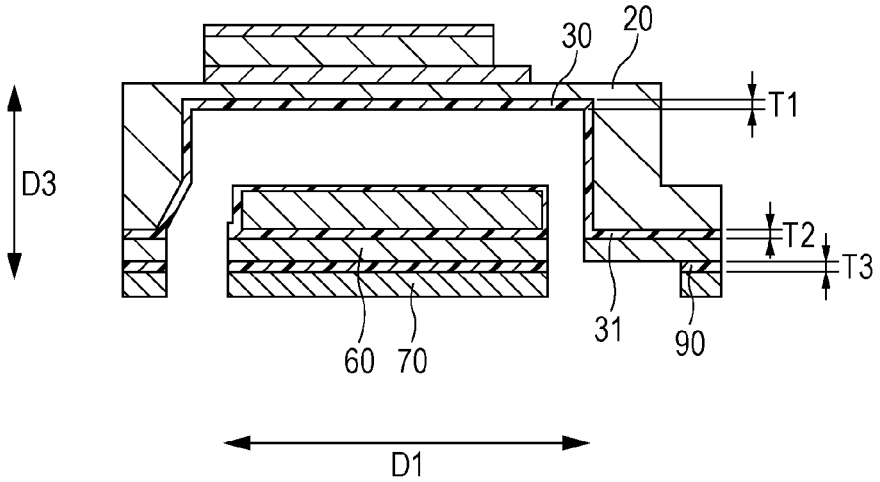

FIGS. 4A to 4B are diagrams which illustrate the bonding between the substrates. FIG. 4A is a planar diagram which shows the lower surface 20*a* of the flow path forming substrate 20. In order to simplify the description, only the coating film 30 which protrudes to the periphery of the communication hole side opening 24 and the reservoir side opening 25 is shown in FIG. 4A, but the coating film 30 is also formed continuously over the entire area of the lower surface 20*a* in practice.

In the process of depositing the coating film 30, there are cases where the coating film 30 is formed to protrude from the communication hole side opening 24 and the reservoir side opening 25 of the flow path forming substrate 20. That is, in the present embodiment, the protruding coating film 30 is also a factor which decreases the precision of the bonding surfaces. Thus, setting the protruding coating film 30 to remain inside the openings (the first communication holes 61 and the common supply hole 62) of the sealing plate 60 by having a large tolerance between the first communication holes 61 and the common supply hole 62 of the sealing plate 60 when the sealing plate 60 and the flow path forming substrate 20 are bonded may be considered. However, when the tolerance between the first communication holes 61 and the common supply hole 62 is excessively large, the tolerance of the openings on the second surface 60*b* side of the sealing plate 60 is also large. Since the joints of the flow path are also formed by the second surface 60*b* of the sealing plate 60 bonding with the reservoir plate 70, it is not desirable in terms of the design to have a large tolerance. Thus, when the bonding film 31 is configured of the same paraxylene as the coating film 30, it is possible to bond the flow path forming substrate 20 and the sealing plate 60 by thermally bonding the bonding film 31 and the coating film 30. That is, it is possible to bond the flow path forming substrate 20 and the sealing plate 60 without considering the influence of the coating film 30 which protrudes to the lower surface 20*a* of the flow path forming substrate 20.

Here, the thicknesses of the coating film 30 and the bonding film 31 have a relationship which is shown in FIG. 4B. That is, a thickness T2 of the bonding film 31 is thicker than a thickness T1 of the coating film 30. As described below, this is due to the film which is formed on the lower surface (the third surface) 20*a* of the flow path forming substrate 20 and the film which is formed on the first surface 60*a* of the sealing plate 60 being thermally bonded. Naturally, in a case where the bonding film 31 is formed other than by thermal bonding, the thickness of each of the parts is not limited thereto.

Returning to FIG. 1 and FIG. 2, the reservoir plate which is a thin plate type is bonded at the second surface 60*b* side of the sealing plate 60. The reservoir plate 70 is a thin plate body which has a plurality of the second communication holes 71 and a reservoir 72. The second communication hole 71 is configured as a hole which connects the openings which are formed in an upper surface 70*a* which is the surface of the side which opposes the sealing plate 60 of the reservoir plate 70 and in a lower surface 70*b* which is the surface of the side which opposes the nozzle plate 80 of the reservoir plate 70. In addition, the reservoir 72 is configured as a rectangular slit of which the longitudinal side extends in the second direction D2 and which connects the openings which are formed in the upper surface 70*a* and the lower surface 70*b*.

The reservoir plate 70 is configured, for example, of ceramics where partially stabilized zirconia or stabilized zirconia is used, or a metal such as aluminum oxide ($Al_2O_3$).

As described above, since it is not necessary to consider the precision of the positional alignment of the first surface 60*a* side of the sealing plate 60, it is possible to bond the sealing plate 60 and the reservoir plate 70 via an adhesive film 90 which is configured of an adhesive. Here, the adhesive film 90 is a film which is formed using an olefin-based adhesive which is different material from paraxylene, or an epoxy resin-based adhesive. The second communication hole 71 of the reservoir plate 70 communicates with the first communication hole 61 of the sealing plate 60 via the adhesive film 90. In addition, the reservoir 72 communicates with the common supply hole 62 of the sealing plate 60 via the adhesive film 90.

In addition, as shown in FIG. 4B, a thickness T3 of the adhesive film 90 in the third direction D3 is thinner than the thickness T2 of the bonding film 31 in the third direction D3.

Furthermore, the nozzle plate 80 is fixed in the lower part of the sealing plate 60. The nozzle plate 80 is a thin plate body where a plurality of nozzle holes 81 are formed along the second direction at predetermined intervals. In addition, each of the nozzle holes 81 individually communicates with the second communication hole 71 of the sealing plate 60.

The nozzle plate 80 is configured, for example, of ceramics where partially stabilized zirconia or stabilized zirconia is used, or a metal such as aluminum oxide ($Al_2O_3$). The reservoir plate 70 and the sealing plate 60 are bonded via an adhesive which is not shown in the diagram.

In addition, the nozzle plate 80 may adopt a configuration where a plurality of nozzle arrays where a plurality of nozzle holes 81 are formed along the second direction D2 are arranged to line up along the first direction D1, and where one nozzle array and another nozzle array are arranged to be shifted in the second direction D2 (so called staggered arrangement).

A compliance plate which is not shown in the diagram may be positioned between the reservoir plate 70 and the nozzle plate 80. The compliance plate absorbs the pressure which is generated in the reservoir 72 and keep the pressure changes in the reservoir 72 constant. For example, the reservoir plate is configured of a metal portion and a film portion which is displaced by the pressure which is generated in a common liquid chamber.

In the liquid ejecting head 1 with the configuration described above, the pressure chamber 22 communicates with the nozzle hole 81 through the communication hole side opening 24, the first communication hole 61, and the second communication hole 71 by each of the substrates being bonded in a laminated manner. In addition, the pressure chamber 22 communicates with the reservoir 72 through the reservoir side opening 25 and the common supply hole 62. Then, the nozzle hole 81 and the reservoir 72 configure the liquid flow path by communicating through the pressure chamber 22.

Therefore, a liquid such as ink which is supplied from an ink cartridge as liquid storage means which is not shown in the diagram is filled in the reservoir 72 and flows in the liquid flow path. In this state, when the driving voltage from a circuit substrate which is not shown in the diagram is applied to the common electrode 41 or the individual electrodes 42 via cables, the pressure generating elements 40 are distorted. The distortion of the pressure generating elements 40 generates pressure changes in the pressure chamber 22 by vibrating the diaphragm 21. Then, according to the pressure changes inside the pressure chamber 22, the ink which is filled in the communication holes (the first communication hole 61 and the second communication hole 71) is discharged from the nozzle holes 81 to the outside.

In addition, the liquid ejecting head 1 is mounted on an ink jet printer 200 by configuring a part of an ink jet type recording head unit which is equipped with an ink supply passage which communicates with an ink cartridge or the like as liquid storage means. The ink jet printer 200 is an example of a liquid ejecting apparatus.

Figure 5:
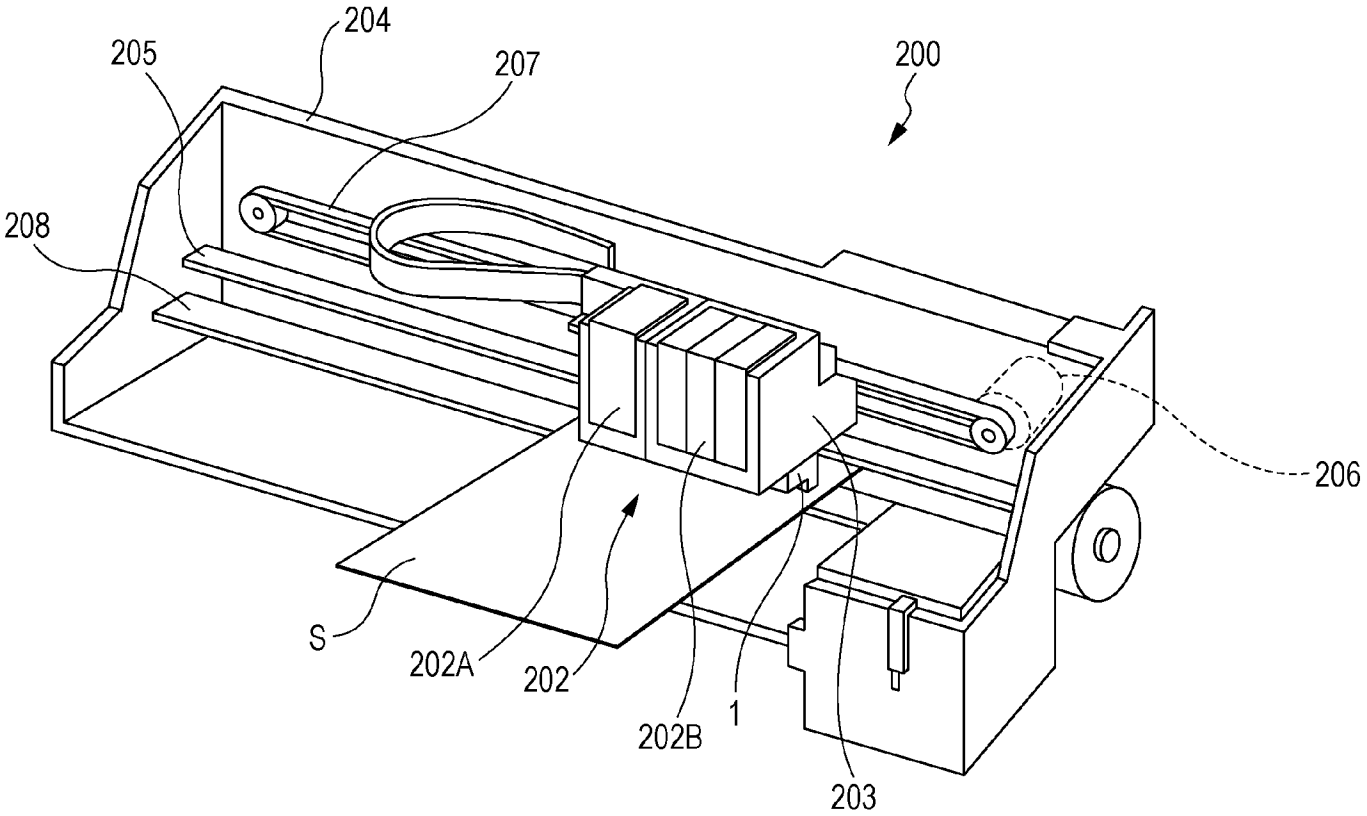
FIG. 5 is a schematic diagram which shows an example of an ink jet printer.

FIG. 5 is a schematic diagram which shows an example of the ink jet printer 200. In FIG. 5, reference number 1 indicates a part of a case (a head cover) where the liquid ejecting head 1 is accommodated while the nozzle hole surface thereof is exposed to the outside. In the ink jet printer 200, for example, ink cartridges 202A, 202B, and the like are provided so as to be attachable to and detachable from the ink jet type recording head unit (below, a head unit 202) which has a plurality of liquid ejecting heads 1. A carriage 203 where the head unit 202 is mounted is provided on a carriage shaft 205 which is attached to an apparatus main body 204 to be freely movable in the axis direction. Then, the carriage 203 moves along the carriage shaft 205 by the driving power of a driving motor 206 being transmitted to the carriage 203 via a plurality of gears which are not shown in the diagram and a timing belt 207.

A platen 208 is provided in the apparatus main body 204 along the carriage shaft 205 and a print medium S which is supplied by a roller or the like which is not shown in the diagram is transported on the platen 208. Then, ink is ejected from the nozzle holes 81 of the liquid ejecting head 1 with regard to the print medium S which is transported, and an arbitrary image is printed on the print medium S. Here, in addition to a printer where the head unit 202 moves as described above, the ink jet printer 200 may be a so called line head type printer where, for example, printing is performed simply by fixing the liquid ejecting head 1 and moving the print medium S.

FIGS. 6A to 6C, FIGS. 7A to 7C, and FIGS. 8A to 8C are process diagrams which illustrate a method of manufacturing the liquid ejecting head 1. Below, description will be given of the method of manufacturing the liquid ejecting head 1 using FIGS. 6A to 8C.

Figure 6A:
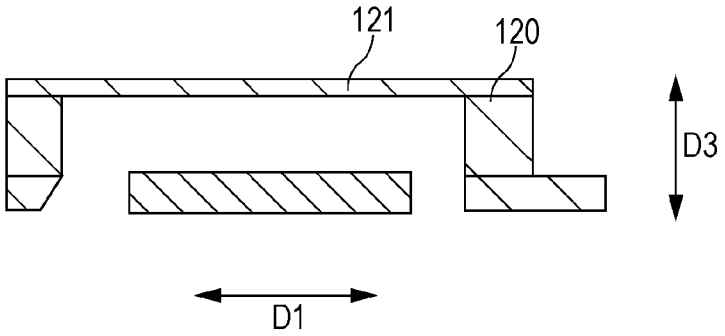
FIGS. 6A to 6C are process diagrams which illustrate a method of manufacturing a liquid ejecting head.
Figure 6B:
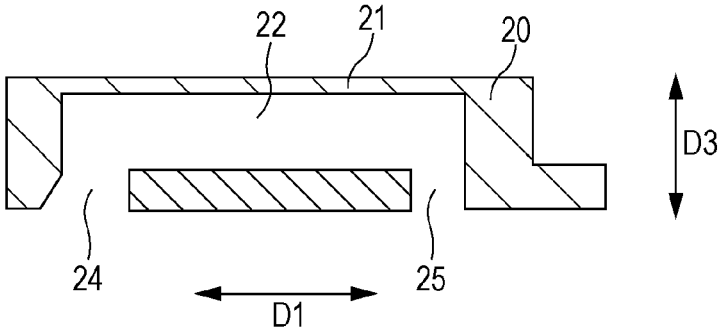

Firstly, the diaphragm 21 and pre-firing ceramic sheets (precursors) 120 and 121 which correspond to the flow path forming substrate 20 are prepared. Then, with regard to the ceramic sheet 120 which corresponds to the flow path forming substrate 20, the pressure chamber 22, the communication hole side opening 24, and a through hole which is equivalent to the reservoir side opening 25 are formed by carrying out a punching out process. Then, as shown in FIG. 6A, each of the ceramic sheets 120 and 121 are laminated. After that, the flow path forming substrate 20 as shown in FIG. 6B is created by firing each of the ceramic sheets at a temperature of 1000 degrees to 1400 degrees.

Figure 6C:
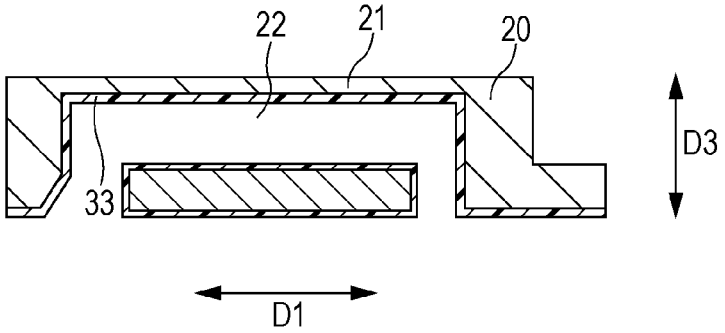

Next, as shown in FIG. 6C, an upper side coating film 33 is deposited on the flow path wall surface of the flow path forming substrate 20, that is, the wall surface which configures the pressure chamber, the surface of the flow path which communicates with the upstream side and the downstream side, and the surface of the side which is bonded with the sealing plate 60 later. Here, the upper side coating film 33 is a film which is a part of the coating film 30 and the bonding film 31. It is possible to use, for example, Parylene (a registered trademark) which is commonly known in a case of using a paraxylene-based resin as a material of the upper side coating film 33. In a case of using a paraxylene-based resin for a material, firstly, a paraxylene-based monomer is generated by vaporizing and thermally decomposing a paraxylene-based solid dimer. Then, depositing is carried out by reacting the paraxylene-based monomer with the flow path forming substrate 20 which is arranged inside a chamber. More specifically, the upper side coating film 33 may be deposited by using the Chemical Vapor Deposition (CVD) method.

Figure 7A:
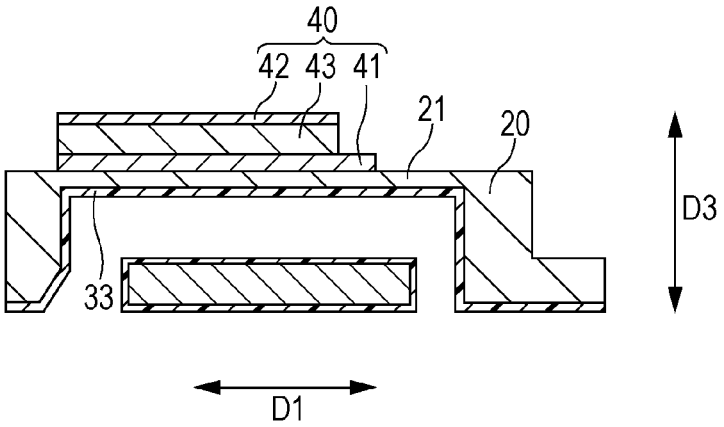
FIGS. 7A to 7C are process diagrams which illustrate a method of manufacturing the liquid ejecting head.

Next, as shown in FIG. 7A, pressure generating elements 40 are formed on the upper surface side of the flow path forming substrate 20 according to the position of the pressure chamber 22. As an example of the forming method of the pressure generating elements 40, an electrode film is deposited on the upper surface side of the diaphragm 21, and the common electrode 41 is formed by patterning this film. Next, a precursor layer which is a pre-firing piezoelectric body is deposited on an upper section of the common electrode 41. Then, the piezoelectric body 43 is formed by firing and patterning the precursor layer. Finally, individual electrodes are formed in the upper section of the piezoelectric body 43 according to each of the pressure chambers 22 by the same method as the common electrodes.

Examples of the forming method of the precursor layer include methods such as an ion beam method, sputtering, vacuum deposition, PVD, ion plating, and CVD.

Figure 7B:
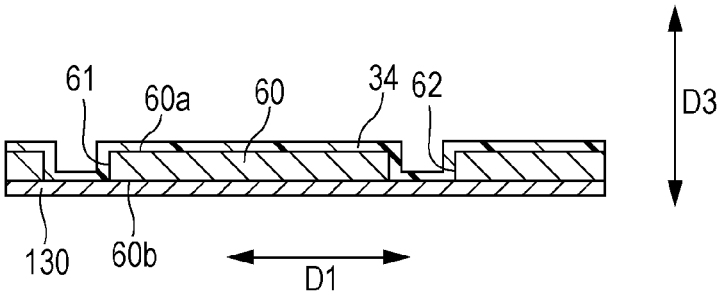

Next, the sealing plate 60 is prepared. The sealing plate 60 may be formed of ceramics instead of being formed of metals. Next, a mask 130 is applied to the second surface 60*b* of the sealing plate 60. Then, as shown in FIG. 7B, the lower side coating film 34 is deposited over the entire first surface 60*a* of the sealing plate 60. The lower side coating film 34 is a film which is a part of the bonding film 31. The mask 130 is removed after depositing the lower side coating film 34. Here, the lower side coating film 34 which is formed inside the first communication hole 61 or the common supply hole 62 of the sealing plate 60 may or may not be removed.

Figure 7C:
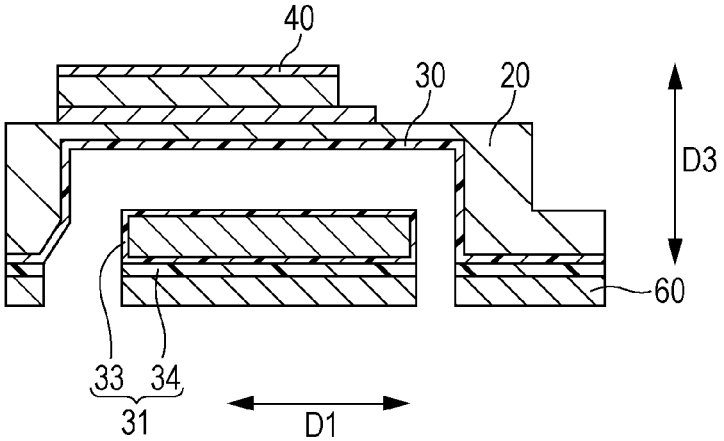

Next, as shown in FIG. 7C, the upper side coating film 33 which is deposited on the flow path forming substrate 20 and the lower side coating film 34 which is deposited on the sealing plate 60 are thermally bonded. As an example, firstly, the upper side coating film 33 and the lower side coating film 34 are each heated to their melting points or higher using a heater or the like. In a case where the coating film 30 is configured of a paraxylene-based resin, the upper side coating film 33 and the lower side coating film 34 are heated at a temperature range of 140 degrees to 200 degrees. Next, the portion which is formed on the lower surface 20*a* of the flow path forming substrate 20 in the upper side coating film 33 and the lower side coating film 34 are bonded and bonded while adding pressure (1.4 MPa to 2.0 MPa). Therefore, the upper side coating film 33 and the lower side coating film 34 are integrated, and the bonding film 31 is formed between the flow path forming substrate 20 and the sealing plate 60. The positional alignment of the flow path forming substrate 20 and the sealing plate 60 is performed using, for example, a jig.

Figure 8A:
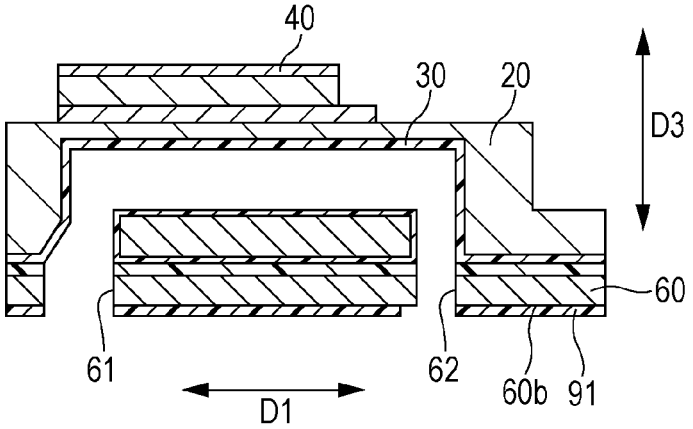
FIGS. 8A to 8C are process diagrams which illustrate a method of manufacturing the liquid ejecting head.

Next, as shown in FIG. 8A, a precursor layer 91 which is the basis of the adhesive film 90 is formed on the second surface 60*b* of the sealing plate 60. The precursor layer 91 is formed by using a film which is coated with an olefin-based adhesive to transfer the olefin-based adhesive to the sealing plate 60. Here, openings are shaped in the film according to the position of the first communication hole 61 or the common supply hole 62 of the sealing plate 60, and the position of the second communication hole 71 or the reservoir 72 of the reservoir plate 70. In addition, each of the openings which are formed in the film is formed to be larger than the sizes of the holes of the first communication hole 61, the common supply hole 62, the second communication hole 71 and the reservoir 72 corresponding thereto. However, since the positional alignment precision between the substrates of the sealing plate 60 is kept higher than the first surface 60*a*, it is possible to bond the substrates with each other using an adhesive (an adhesive film) in the form of a film which is formed such that the openings are large. Here, the adhesive which was transferred to the second surface 60*b* of the sealing plate 60 is the precursor layer 91. Naturally, the forming method of the precursor layer 91 may be a method other than this.

Figure 8B:
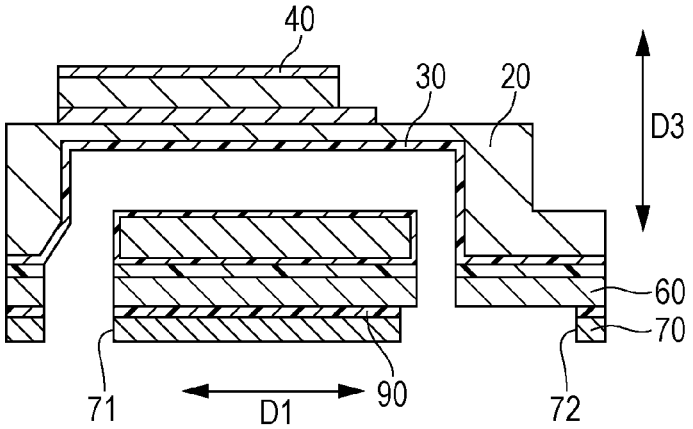

Next, as shown in FIG. 8B, the reservoir plate 70 is bonded on the side of the sealing plate 60 where the precursor layer 91 is formed. At this time, the positional alignment of the sealing plate 60 and the reservoir plate 70 is carried out using a jig. Then, the adhesive is cured and the adhesive film 90 is formed between the sealing plate 60 and the reservoir plate 70 by crimping and holding the sealing plate 60 and the reservoir plate 70 while carrying out the positioning.

Figure 8C:
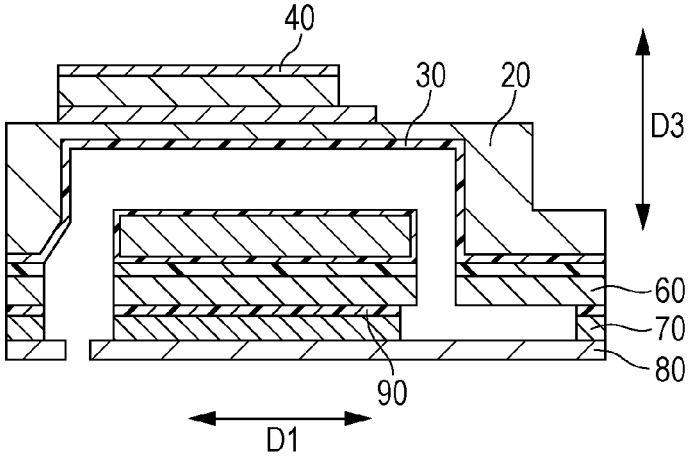

Finally, as shown in FIG. 8C, the nozzle plate 80 is adhered to the reservoir plate 70. The nozzle plate 80 is, for example, adhered to the reservoir plate 70 in the same manner as the adhesive film 90 using an olefin-based adhesive which is a different material from paraxylene.

By the processes described above, the liquid ejecting head 1 according to the first embodiment is manufactured.

As described above, in the first embodiment, the first surface 60*a* of the sealing plate 60 which is bonded with the flow path forming substrate 20 is bonded via the film of paraxylene. On the other hand, the second surface 60*b* of the sealing plate 60 which is bonded with the reservoir plate 70 is bonded via an adhesive other than paraxylene. Typically, in a case where a flow path is formed by superimposing three substrates, it is necessary to bond the substrates while considering the precision of the positional alignment of each of the substrates. However, in the invention, it is possible to bond the joints of the flow path while covering the joints of the flow path using the film of paraxylene, and it is possible to properly configure the flow path even in a case where the precision of the positional alignment of the sealing plate 60 and the flow path forming substrate 20 is poor. On the other hand, it is possible to easily bond the substrates with each other without the reservoir plate 70 and the sealing plate 60 being influenced by the precision of the positional alignment of the first surface 60*a* side. Therefore, it is possible to properly configure the flow path.

In a case where the flow path forming substrate 20 is configured of ceramics, there are cases where variations occur in the dimensional precision due to shrinkage caused by firing. However, according to the invention, it is possible to absorb decreases in the precision of the positional alignment which occur by configuring the flow path forming substrate 20 using ceramics. As a result, it is possible to use ceramics which make it possible to reduce costs and it is possible to reduce manufacturing costs.

In addition, when the pressure chamber 22 which is formed in the flow path forming substrate 20 is reduced in size, it is difficult to generate a uniform film even when the coating film is deposited by a known method such as CVD. However, it is possible to make the film thickness of the coating film which is deposited inside the liquid flow path uniform when the substrates are fixed to each other by adhering the films to each other after depositing the coating film 30 and the bonding film 31 separately.

2. Second Embodiment

Figure 9:
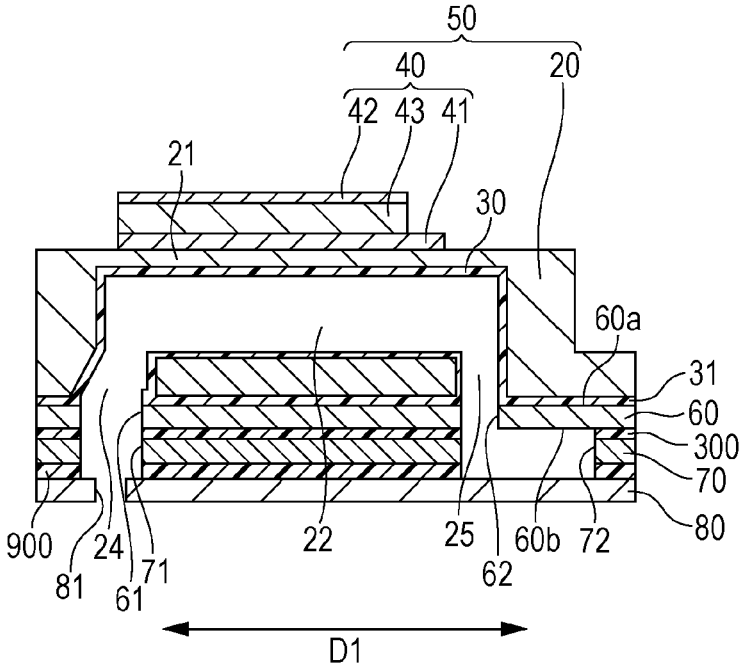
FIG. 9 is a cross sectional diagram which shows a configuration of a liquid ejecting head according to a second embodiment.

FIG. 9 is a cross sectional diagram which shows the liquid ejecting head 2 according to the second embodiment. The liquid ejecting head 2 is different from the liquid ejecting head 1 according to the first embodiment in the configuration which is provided with a bonding film 300 which is configured of paraxylene between the sealing plate 60 and the reservoir plate 70.

In the same manner as in the first embodiment, the liquid ejecting head 2 is provided with the actuator 50, the sealing plate 60, the reservoir plate 70, and the nozzle plate 80. In addition, a liquid flow path which is provided with the pressure chamber 22 in a part is formed by combining the actuator 50, the sealing plate 60, the reservoir plate 70 and the nozzle plate 80.

Then, the actuator 50 is provided with the flow path forming substrate 20 and the pressure generating element 40.

The sealing plate 60 and the reservoir plate 70 are bonded via the bonding film 300 which is configured of paraxylene. In addition, the reservoir plate 70 and the nozzle plate 80 are bonded via an adhesive film 900 which is configured of an adhesive. That is, in the second embodiment, the nozzle plate 80 is the first flow path substrate, and the reservoir plate 70 and the sealing plate are the second flow path substrate. In addition, the flow path forming substrate 20 is the third flow path substrate.

Here, in the same manner as in the first embodiment, it is possible to use an olefin-based adhesive which is a different material from paraxylene, or an epoxy resin-based adhesive for the adhesive film 900. Then, in the same manner as in the first embodiment, the thickness of the bonding film 300 in the third direction is thicker than the thickness of the adhesive film 900 in the third direction.

In FIG. 9, in the same manner as in the first embodiment, the coating film 30 of paraxylene is deposited on the inner wall of the pressure chamber 22 of the flow path forming substrate 20. In addition, the coating film 30 is bonded with the flow path forming substrate 20 and the sealing plate 60, via the bonding film 31. Although not shown in the diagram, the bonding film 31 and the bonding film 300 may be formed continuously inside the first communication hole 61 and the common supply hole 62 of the sealing plate 60.

As described above, the second embodiment achieves the same effects as the effects which are achieved by the first embodiment.

3. Other Embodiments

There are various embodiments in the invention. Therefore, the basic configuration of the liquid ejecting head which is shown in the embodiments is not limited to the above description. For example, the arrangement of the pressure chambers 22 is not limited to being arranged linearly in the second direction D2. For example, the pressure chambers 22 may be arranged in a staggered manner, or may each be arranged in a matrix shape in the first direction D1 and the second direction D2.

In addition, the invention is to be widely applied to any kind of liquid ejecting head, and naturally, it is possible to apply the invention to liquid ejecting heads which eject liquids other than ink. Examples of other liquid ejecting heads include various types of recording heads which are used in image recording apparatuses such as printers; a color material ejecting heads which are used for manufacturing color filters such as a liquid crystal displays; electrode material ejecting heads which are used for electrode forming such as for organic EL displays and FEDs (field emission displays); bio organic matter ejecting heads which are used for bio chip manufacturing; and the like.

Here, it is needless to say that the invention is not limited to the embodiments described above.

That is, the invention may be applied by appropriately changing mutually replaceable members, configurations, and the like, which are disclosed in the embodiments described above, and combinations thereof.

The invention may be applied by appropriately replacing members, configurations, and the like, which are disclosed in the embodiments described above, with mutually replaceable members, configurations which are known techniques, and the like, and changing the combinations thereof.

The invention may be applied by appropriately carrying out replacement with members, configurations, and the like which a person skilled in the art may be consider to be alternatives to the members, configurations, and the like disclosed in the embodiments described above based on known techniques or the like, and changing the combinations thereof.

The entire disclosure of Japanese Patent Application No. 2013-166883, filed Aug. 9, 2013 is expressly incorporated by reference herein.

What is claimed is:

1. A flow path unit, which has a liquid flow path through which liquid flows, comprising:

a first flow path substrate where a first flow path out of the liquid flow path is formed;

a second flow path substrate which has a first surface and a second surface which is bonded to oppose the first flow path substrate and where a second flow path which communicates with the first flow path is formed; and a third flow path substrate which is bonded to oppose the first surface of the second flow path substrate and where a pressure chamber which communicates with the second flow path is formed, wherein the first surface of the second flow path substrate is bonded with the third flow path substrate via a film of paraxylene, and the second surface of the second flow path substrate is bonded with the first flow path substrate via an adhesive film of a material which is different from that of the film of paraxylene.

2. The flow path unit according to claim 1, wherein the film of paraxylene which bonds the second flow path substrate and the third flow path substrate includes a first film which is formed on a wall surface of the pressure chamber of the third flow path substrate and a third surface on the second flow path substrate side of the third flow path substrate.

3. The flow path unit according to claim 2, wherein the film of paraxylene which is interposed between the second flow path substrate and the third flow path substrate is thicker compared to the film thickness of the first film.

4. The flow path unit according to claim 1, wherein the third flow path substrate is configured of ceramics.

5. A liquid ejecting head comprising:

the flow path unit according to claim 1; and a nozzle plate which has nozzle holes which communicate with the liquid flow path.

6. A liquid ejecting apparatus which has the liquid ejecting head according to claim 5.

7. A method of manufacturing a flow path unit which has a liquid flow path through which liquid flows, the method comprising:

bonding a first flow path substrate where a first flow path out of the liquid flow path is formed with a second surface side of a second flow path substrate where a second flow path which communicates with the first flow path is formed; and bonding a third flow path substrate where a pressure chamber which communicates with the second flow path is formed with a first surface which opposes the second surface of the second flow path substrate, wherein the first surface of the second flow path substrate is bonded with the third flow path substrate via a film of paraxylene, and the second surface of the second flow path substrate is bonded with the first flow path substrate via an adhesive of a material which is different from that of the film of paraxylene.

* * * * *